United States Patent [19]

Watt

[11] Patent Number: 5,026,070

[45] Date of Patent: Jun. 25, 1991

[54] STRATEGY BOARD GAME

[76] Inventor: James S. Watt, P.O. Box 1104, Kapaa, Hi. 96746

[21] Appl. No.: 494,583

[22] Filed: Mar. 16, 1990

[51] Int. Cl.[5] ..... A63F 3/02

[52] U.S. Cl. ..... 273/261; 273/239; 273/246; 273/255; 273/260; 273/262; 273/290

[58] Field of Search ..... 273/239, 246, 255, 260, 273/261, 262, 240

[56] References Cited

U.S. PATENT DOCUMENTS

| | | | |
|---|---|---|---|
| 511,773 | 1/1894 | Higgins | 273/261 |
| 972,382 | 10/1910 | Johnson-Jervis | 273/255 |
| 2,391,147 | 12/1945 | Fredriksson | 273/290 X |
| 3,556,526 | 1/1971 | Currie | 273/290 X |
| 3,831,944 | 8/1974 | Upton | 273/262 |
| 4,147,360 | 4/1979 | Bailey | 273/261 |
| 4,234,188 | 11/1980 | Keegan | 273/290 |
| 4,326,720 | 4/1982 | Erlich | 273/290 X |
| 4,643,432 | 2/1987 | Berry | 273/290 X |
| 4,763,788 | 9/1988 | Gates | 273/246 |
| 4,765,627 | 8/1988 | Ross | 273/255 |

*Primary Examiner*—Edward M. Coven
*Assistant Examiner*—Raleigh W. Chiu
*Attorney, Agent, or Firm*—Hoffmann & Baron

[57] ABSTRACT

A strategic naval warfare board game includes a game board having a playing surface with compass headings and position indicia. The playing surface has a plurality of squares of alternating colors arranged contiguously in a checkerboard fashion and naval bases at the corners. A plurality of primary playing pieces, representing five different types of naval vessels, include a base member and a post of different heights mounted on the base member in an upright position. A plurality of secondary playing pieces in the form of cylindrical rings are adapted to be loosely mounted on the posts of the primary playing pieces in a stacked arrangement and removable therefrom. The ring-shaped secondary playing pieces represent either a unit or power or a unit of damage. A stacked arrangement of secondary playing pieces which represent units of power on a primary playing piece is indicative of the relative strength of the primary playing piece for movement, fire power and repair. Aircraft squadrons operate from six different altitudes. Submarines operate from six different depths. The objective of the game is to capture an opponent's naval bases.

15 Claims, 6 Drawing Sheets

STRATEGY BOARD GAME

BACKGROUND OF THE INVENTION

1. Field of the Invention

The present invention relates to board games, and more particularly to a strategic naval warfare game played on a checker-style board and including playing pieces which indicate their respective power or strength by carrying rings on segmented posts.

2. Description of the Prior Art

Strategy board games played on checker-style boards are well known in the art. For example, U.S. Pat. No. 4,643,432, which issued to William J. Berry, discloses a board game which is played on a board of 100 squares arranged in a 10×10 pattern of alternating light and dark squares. The primary playing pieces of the game are rings and pegs, and each of two players controls either all of the rings or all of the pegs. Either the ring or the peg may capture the other and indicate such a condition of capture by interlocking the ring to the peg, with the dominant piece placed atop the captured piece.

The rings and pegs of the board game disclosed in the Berry patent are intended to interfit snugly with each other, indicating a complete loss of mobility. The rings do not fit loosely on the pegs; hence, each peg can accept only one ring. Since the rings are not stacked on the pegs, they cannot represent the relative or remaining strength of the peg playing pieces.

U.S Pat. No. 4,679,798, which issued to Robert E. Dvorak, discloses a board game comprising primary playing pieces which carry a limited quantity of secondary playing pieces of varying sizes. These secondary pieces, however, are not indicative of the capability or strength of the primary piece on which they are carried.

U.S. Pat. No. 4,200,293, which issued to Harry Benson, III, discloses a board game comprising playing pieces which accept indicia which display the ability of the piece to maneuver about the board, but which do not provide a means to reduce the indicated strength or capability of the playing piece.

OBJECTS AND SUMMARY OF THE INVENTION

It is an object of the present invention to provide a game board and playing pieces which are to be used to play a game of strategy and chance for the entertainment of the players and spectators.

It is another object of the invention to provide a game of strategy and chance in which playing pieces start the game with an established maximum power, such power being represented by the number of cylindrical rings which slide over vertical posts of varying height, such posts being an integral part of each of a plurality of playing pieces, the maximum power of each playing piece diminishing with each successful attack made against that playing piece and the resulting reduction in power being represented by the removal of a specific number of power-representing rings and replacement by an equal number of damage-representing rings.

It is yet another object of the invention to provide a strategic naval warfare game in which a plurality of playing pieces representing various aircraft, naval vessels, and underwater mines are maneuvered around a game board in an attempt to damage or destroy a sufficient number of opposing playing pieces to enable invasion and capture of an opponent's naval bases. A point scoring system can be used to evaluate competitive contests.

It is yet a further object of the invention to provide a method of game play which governs the movement of playing pieces and the confrontations between those playing pieces.

In one form of the present invention, a strategy board game includes 16 dice, a game board and 40 different primary playing pieces. Half of the dice and half of the playing pieces are of one color such as black and the other half of the dice and playing pieces are of a contrasting color such as white. The primary playing pieces represent various types of naval warships, aircraft squadrons and underwater mines. Two opposing players each control and direct two battleships, two cruisers, two aircraft-carriers, four destroyers, six submarines, two fighter-bomber squadrons and two underwater mines.

Each primary playing piece which represents a naval warship includes a segmented post mounted vertically on a base or pedestal. The segmented posts are provided to accept two kinds of secondary playing pieces in the form of rings which are differentiated by color. Clear rings denote the amount of residual power of warships and red rings denote the amount of damage to warships. Each ring when stacked vertically on a warship playing piece covers exactly one post segment. Playing pieces which represent battleships have a post with six segments which allows it to be capable of holding six rings stacked one atop the other. Playing pieces which represent cruisers have a post with five segments which allows five rings to be stacked on the piece. Aircraft carrier playing pieces have posts with four segments capable of carrying four rings, and further can support a detachable playing piece which represents a squadron of a number (such as six) of fighter-bomber aircraft. Playing pieces which represent destroyers have a post with three segments which can support three rings. Submarine playing pieces have a post with two segments which can support two rings. Playing pieces representing underwater mines are in the form of solid cylindrical pieces on the underside of which a player writes the coordinates to define the location of the mine on the game board.

The game board is a matrix of 144 squares arranged in four quadrants: the northeast quadrant; the southeast quadrant; the northwest quadrant; and the southwest quadrant. Numerical and compass coordinates identify each square of each quadrant. The center 64 squares are distinguishable from the outermost surrounding 80 squares by having a darker color.

Sixteen dice are included, eight white and eight black. Each player uses eight dice. Two dice are used to indicate the altitude of each player's two fighter-bomber squadrons by placing them on top of the piece. The remaining six dice are used by each player to attack the opponent's playing pieces with fire-power and thereby reduce or eliminate the number of power unit rings on each targeted vessel which is successfully attacked.

A preferred form of the board game, as well as other embodiments, objects, features and advantages of this invention, will be apparent from the following detailed description of illustrative embodiments thereof, which is to be read in connection with the accompanying drawings.

BRIEF DESCRIPTION OF THE DRAWINGS

FIG. 1 is a perspective view of the strategy board game of the present invention and its component parts.

FIG. 2 is a top planar view of the game board of the present invention.

FIG. 3 is a perspective view of a first primary playing piece of the strategy board game invention, the first primary playing piece representing a battleship.

FIGS. 4*a* through 4*d* are side elevational views of a first primary playing piece through a fourth primary playing piece, showing the stacked arrangement of secondary playing pieces on the vertical center posts of the respective primary pieces, the first primary playing piece representing a battleship, the second primary playing piece representing a cruiser, the third primary playing piece representing a destroyer, and the fourth primary playing piece representing a submarine.

FIG. 5 is a side elevational view of a second alternative embodiment of the first through the fourth primary playing pieces.

FIGS. 5*a* through 5*d* are side elevational views of third alternative embodiments of the first primary playing piece through the fourth primary playing piece, without the stacked secondary playing pieces to show the number of ring holding segments on the vertical center posts of the respective primary pieces, the first primary playing piece representing a battleship, the second primary playing piece representing a cruiser, the third primary playing piece representing a destroyer, and the fourth primary playing piece representing a submarine.

FIG. 6 is a perspective view of a fifth primary playing piece of the strategy board game invention, which fifth primary playing piece represents an aircraft carrier.

FIG. 7 is a side elevational view of the fifth primary playing piece shown in FIG. 6, representing an aircraft-carrier, showing the stacked arrangement of secondary playing pieces.

FIG. 7*a* is a side elevational view of the fifth primary playing piece shown in FIG. 7, without the stacked secondary playing pieces to show the number of ring holding segments on the vertical cylindrical off-center post of the playing piece.

FIG. 8 is a perspective view of a sixth primary playing piece representing an aircraft squadron.

FIG. 9 is a side elevational view of the sixth primary playing piece representing an aircraft squadron, shown in FIG. 8, mounted on top of the fifth primary playing piece representing an aircraft carrier.

FIG. 10 is a perspective view of a seventh primary playing piece of the present invention, the seventh primary playing piece representing an underwater mine.

FIG. 11 is a perspective view of a secondary playing piece of the present invention, which secondary playing piece is in the form of a cylindrical ring which represents either a power-unit if clear or a damage unit if red.

DETAILED DESCRIPTION OF THE PREFERRED EMBODIMENTS

Initially referring to FIGS. 1 and 2 of the drawings, a strategy board game constructed in accordance with the present invention basically includes a flat planar board or member 2 having a playing surface 4. In one preferred form, the playing surface comprises 144 squares 6 arranged in a 12 ×12 matrix. This matrix is subdivided into four quadrants —the northwest quadrant 8, the northeast quadrant 10, the southeast quadrant 12 and the southwest quadrant 14. The quadrants each have 36 squares arranged in a 6×6 submatrix which makes up ½ of the total playing surface 4. Each of the quadrants are identical with exception only in regard to their location on the board and color sequencing. The playing surface 4 may include a peripheral border 16 containing indicia 18 in the form of compass headings (i.e, North; South; East; and West) to help identify the various quadrants 8–14 of the playing surface.

The playing surface 2 is further divided into two distinct zones—an inner zone 20, comprising the center squares, and an outer zone 22, comprising the more outwardly situated squares of the playing surface. More specifically, the inner zone 20 has 64 squares arranged in an 8×8 matrix located at the center of the playing surface 4. The outer zone 22 circumscribes and is concentric to the inner zone, and is made up of 80 squares symmetrically situated around the inner zone.

The squares 6 of the playing surface are distinguishable by color. As the strategy board game of the present invention is preferably intended to be a naval warfare game, the preferred colors of the squares are either a light, medium or dark shade of blue to symbolize the ocean. The squares in the outer zone 22 alternate between a medium shade of blue and a light shade of blue. The squares of the inner zone 20 alternate between a dark shade of blue and a light shade of blue, the light shade of blue used in the inner zone being identical to the light shade of blue used in the outer zone.

The inner and outer zones 20, 22 are arranged so that the light squares of both zones form a continuity of diagonal lines of squares which touch each other only at their corners. The inner and outer zones 20, 22 are further arranged so that the dark squares of the inner zone and the medium dark squares of the outer zone also form a continuity of diagonal lines of squares which touch each other only at their corners.

Preferably, the border 16 further includes indicia 24 in the form of numbers prefaced with the compass headings (i.e., N1–N6; S1–S6; E1–E6; and W1–W6) to help identify the location of any particular square 6 on the playing surface.

The playing surface 4 is further divided into its quadrants 8–14 by two lines 26, 28 which intersect at right angles at the center of the board. One line 26 represents the "East-West" coordinate, while the other line 28 represents the "North-South" coordinate. Accordingly, any particular square on the board may be identified by providing the two coordinates of the square from the indicia 24 located on adjacent sides of the playing surface border, ex., NIE3.

The strategy board game of the present invention includes 40 different primary playing pieces. The primary playing pieces come in two colors, so that each player can distinguish his primary playing pieces from those of another player.

The primary playing pieces represent five different types of naval vessels or warships—battleships, cruisers, destroyers, aircraft carriers and submarines—as well as aircraft squadrons and underwater mines. As will be described, the warship-representing primary playing pieces include a pedestal or base 32*a*–32*e* and a vertical post 34*a*–34*e*.

FIG. 3 is a perspective view of a first primary playing piece 30 which represents a battleship. The battleship playing piece 30 includes a relatively wide cylindrical pedestal or base 32*a*, and a cylindrical post 34*a* of lesser diameter than the base, mounted vertically on the base.

In play, the first primary playing piece 30, like the other primary playing pieces representing naval vessels, is placed on one of the squares of the playing surface, the base 32*a* resting on the square and supporting the post 34*a* in a vertical position to support a specific number of secondary playing pieces 36.

The strategy board game of the present invention includes two kinds of secondary playing pieces in the form of cylindrical rings 36, as shown in FIG. 11. Each ring 36 has a central bore 36' having an inner diameter which is slightly greater than the outer diameters of the posts 34*a*–34*e* of the primary playing pieces. The two kinds of rings 36 represent either power or damage and are distinguishable by color. More specifically, the rings are defined either as power rings, representing power-units, if they are made from a clear acrylic material, or are defined as damage rings representing damage-units, if they are made from a red tinted acrylic material or red translucent florescent material. The power and damage rings 36 are of uniform dimensions and thicknesses.

Returning to FIG. 3 of the drawings, the primary playing piece 30 representing a battleship is adapted to receive a specific number (for example, six) of power or damage rings 36 on its central post 34*a*. These power and damage rings are stacked one atop the other and extend from the top surface of the base 32*a* vertically upward on the post 34*a*.

The first through the fifth primary playing pieces may include one or more of three heading indicators 38, 38' and 38" which indicate the direction of movement of each warship. The first consists of post-top arrow 38 which extends across the upper horizontal surface of each vertical post. The second consists of a pedestal or base-top arrow 38' located on the upper horizontal surface of each base member, extending from the base of the vertical post to the outer edge of the base and pointing in exactly the same direction as the post-top arrow 38. The third heading indicator consists of a bowline 38" extending from the tip of the base-top arrow 38' vertically down the side of each base member.

The first primary playing piece 30, which represents a battleship, has the tallest post 34*a* of all the playing pieces. This is consistent with the fire-power of the naval warship which it represents, i.e., a battleship. The height of the post 34*a* is defined from the top surface of the base 32*a* to its free end. In its preferred form, the post 34*a* of the first primary playing piece 30 includes a ring accepting portion 34*a'* having a height which is adapted to receive six rings 36 stacked on top of each other plus a post extension or superstructure 34*a"* the length of about four stacked rings. The rings are loosely mounted on the ring accepting portion 34*a'* of the post 34*a* of the playing piece 30 so that they may be removed and replaced with different colored rings, i.e, either power rings of clear acrylic material when the naval vessel playing piece is repaired in a naval-base, or damage rings of a red tinted acrylic material when the naval vessel playing piece is hit by enemy fire-power.

The second through fourth primary playing pieces 40, 42, 44 respectively represent a cruiser, a destroyer and a submarine. The second through fourth primary playing pieces 40–44 are shown in FIG. 4*b* through 4*d*, respectively, with the first primary playing piece 30, representing a battleship, again shown in FIG. 4*a*. It can be seen from the drawings that the second through fourth playing pieces 40–44 are similar in many respects to the first primary playing piece 30. Each includes a cylindrical base 32*b* 32*d*, and a vertical post 34*b*–34*d* mounted on a cylindrical base with the post having a lesser diameter than the base. The first through fourth playing pieces 30, 40–44 preferably have similar diameters for their bases and similar but smaller diameters for their central posts. However, they are distinguishable from each other both by the height of their central posts and by the number of cylindrical rings which they can carry. More specifically, and as shown in a side-by-side comparison of FIGS. 4*a* through 4*d*, the first primary playing piece 30 (see FIG. 4*a*) has a vertical post 34*a* with a height that is adapted to receive six rings 36 plus a superstructure 34*a"* (i.e., an extension of the post) of four ring-units. The second primary playing piece 40, which represents a cruiser, has a vertical post 34*b* which is slightly shorter than that of the first primary playing piece, and can accept five rings 36 in a stacked arrangement on the ring accepting portion 34*b'* of its post plus a superstructure 34*b"* of about two and one half ring-units (see FIG. 4*b*).

Similarly, and as shown in FIG. 4*c*, the third primary playing piece 42, which represents a destroyer, has a vertical post that is smaller in height than the first and second primary playing pieces 30, 40 and has a height which is adapted to receive three rings on the ring accepting portion 34*c'* of its central post 34*c* plus a superstructure 34*c"* of about two ring-units. Likewise, and as shown in FIG. 4*d*, the fourth primary playing piece 44, which represents a submarine, has a post height which is less than those of the first through third primary playing pieces 30, 40, 42 and has a post 34*d* of a height which can accept two rings 36 on its ring accepting portion 34*d'*, with a superstructure 34*d"* of about one half of a ring-unit, the superstructure 34*d"* being a portion of the post which extends above the top ring. The base 32*d* of submarine playing pieces may be divided into two stacked upper and lower portions 32*d'* and 32*d"*. During game play, when the submarine is in a "surface" mode, both upper and lower base portions 32*d'*, 32*d"* are used, and when the submarine is in a submerged mode, only the upper base portion 32*d'* is used and the removeable lower base portion 32*d"* is then set aside.

Accordingly, each primary playing piece representing a naval vessel has a post 34*a*–34*e* of a different height, and can accept a different and specific number of rings 36. Thus, the first through fourth primary playing pieces 30, 40–44, representing a battleship, a cruiser, a destroyer and a submarine, are distinguishable from each other not only by the height of the playing piece, but also by the number of rings mounted on the playing piece.

In one form of the invention, and as shown in FIGS. 4*a* through 4*d*, the first through fourth playing pieces 30, 40–44 have their central posts 34*a*–34*d* extend above the number of rings it is designated to accept so that the playing piece can be both easily differentiated from different type pieces and easily grasped from the extended portion of the central post when a player is making a move. However, an alternative embodiment of the first through fifth playing pieces is where the central post 34*a*–34*d* of each playing piece extends to the level of the stacked arrangement of rings it is designated to accept. This alternative embodiment of the primary playing pieces is shown in FIG. 5. For example, if the first primary playing piece 30 is designated to accept six rings 36 in a stacked arrangement, the height of its central post 34*a'"* above the top surface of the base 34*a* is substantially equal to the height of six rings 36 stacked one on top of each other. Thus, a player would know that the first primary playing piece 30, which represents a battleship, is designated to accept only six rings, as no additional rings may be mounted on the playing piece.

A third alternative embodiment of the primary playing pieces is shown in FIGS. 5*a*–5*d* and 7*a*. In this alternative embodiment, the central vertical post of each playing piece is segmented, with each segment 45 coinciding exactly with the height of each stacked cylindrical ring. For example, if there are x number of segments 45 on the ring accepting portion of the post, then that particular primary playing piece is designated to carry no more than x number of rings 36. Since each segment 45 is the same height as one ring, the number of segments denotes the number of rings that should be carried by a particular primary playing piece. Rings 36 are preferably not carried on the upper non-segmented part of the post or superstructure. Thus, a player would know that the first primary playing piece 30, which represents a battleship, is designated to accept only six rings 36, because it has six post segments 45. The segmented vertical posts allow the game to be played without having to use the clear power-unit rings 36 since the number of power-units available to a warship is readily determined by counting the number of visible post segments 45 not covered by damage-units. Furthermore, red colored damage-unit rings can be assigned directly to warships without having to remove any clear power-unit rings when damage is inflicted on a warship. The post segments 45 which determine the number of power-units of warships in this embodiment of the invention are delineated by slightly indented grooves or other indicia which pass around the circumference of the cylindrical vertical posts at regular intervals and coincide with the exact heights of each stacked ring 36. As an example, if a battleship playing piece having six post segments 45 which represent six power-units acquires two red rings which represent two damage-units, then the residual power of the warship is obvious from the four visible post-segments 45 representing four remaining power-units. On each of the playing pieces shown in FIGS. 5*a*–5*d*, the superstructure mentioned above refers to a portion of the post which extends above the top ring or above the post ring segments.

The strategy board game of the present invention includes a fifth primary playing piece 46, which represents an aircraft carrier. As shown in FIGS. 6 and 7 of the drawings, the fifth primary playing piece 46 includes a cylindrical pedestal or base 32*e*, and a lesser diameter vertical post 34*e* mounted on the top surface of the base. As with the other playing pieces, the post 34*e* of the fifth primary playing piece 46 is adapted to loosely receive a number of rings 36. The height of the playing piece 46, as well as the length of the post 34*e*, is less than that of the first and second primary playing pieces 30, 40, which represent the battleship and the cruiser respectively, such that it can accept only four rings 36 in a stacked arrangement.

The fifth primary playing piece 46, representing an aircraft carrier, is further distinguishable from the other playing pieces in that it includes a second upright post 48, which is of rectangular cross section. The second post 48 is mounted off center on the top surface of the base 32*e* of the playing piece, representing the superstructure of an aircraft carrier which is positioned off to one side of the vessel.

FIG. 7*a* represents an alternative embodiment of the fifth primary playing piece 46 showing a base 32*e* segmented, with the height of each of the four segments 45 coinciding exactly with the height of each stacked cylindrical ring 36. The second post 48 representing the superstructure has a ferrous metallic strip 48*a* at its upper end which is the same height as the segmented off center post 34*e*, both posts together help to stabilize an aircraft-squadron piece 50 when it is positioned on the "flight-deck" on top of the aircraft-carrier playing piece 46.

FIGS. 8 and 9 illustrate a sixth primary playing piece 50 of the strategy board game invention, the sixth primary playing piece representing a squadron of one to six aircraft, such as fighter-bombers. The sixth primary playing piece 50 includes a central elongated member 52, representing the fuselage of the aircraft, and second and third elongated members 54, 56, each of which is mounted transversely to the central member 52 and representing the wings and tail of the aircraft, respectively. Extending downward from the central member 52 is a short transparent post 58, which is mounted on a short transparent cylindrical base 60 having a magnetic disc sub-base 60*a* and a felt underpad 60*b* positioned under the magnetic sub-base.

The sixth primary playing piece 50, which represents the aircraft squadron, is adapted to rest on the top or free ends of the first and second posts 34*e*, 48 of the fifth primary playing piece 46, representing the aircraft carrier. The sixth primary playing piece 50 may rest loosely on top of the fifth primary playing piece 46. Alternatively, the magnetic disc sub-base 60*a* will hold the squadron playing piece 50 on the ferrous strip 48*a* of the carrier playing piece 46 if the carrier playing piece of FIG. 7*a* is used. Again alternatively, the first post 34*e* of the fifth primary playing piece may extend upwardly (above the stacked arrangement of four rings and the second post 48) and be removably received by a recess (not shown) formed in the underside of the cylindrical base 60 of the sixth primary playing piece 50, so that the sixth primary playing piece will not fall off the fifth primary playing piece 46 when the two pieces are moved together.

The strategy board game of the present invention further includes a seventh primary playing piece 62, which represents an underwater mine. The seventh primary playing piece 62 is preferably in the form of a solid cylindrical member, which may be of the same dimensions as the bases 32*a*–32*e* of the first through fifth primary playing pieces.

The bases 32*a*–32*e*, 60 of the primary playing pieces provide support for the piece on the game board. However, it is envisioned to be within the scope of the invention to include a base for each warship playing piece, similar to that described for the sixth primary playing piece 50 in FIG. 8, i.e., having a magnetic disc underbase 63*a* and a felt underpad 63*b*, as shown in FIG. 5, and having a game board 2 which is made of a material, such as a ferrous material, which will be attracted by the magnetic bases of the primary playing pieces. The attraction between the magnetic base of the primary playing pieces and the game board will help maintain stability of the playing pieces in an upright position and keep the playing pieces in their proper location on the game board.

Each player has command of two first primary playing pieces 30 (representing battleships), two second primary playing pieces 40 (representing cruisers), four third primary playing pieces 42 (representing destroyers), six fourth primary playing pieces 44 (representing submarines), two fifth primary playing pieces 46 (representing aircraft carriers), two sixth primary playing pieces 50 (each representing a fighter-bomber squadron initially comprised of six aircraft) and two seventh primary playing pieces 62 (representing underwater mines). The pieces are placed on the playing surface of the board initially as shown in TABLE I below. The underwater mine pieces are placed to the side of the game board near the naval bases and are marked on their underside with the coordinates of where the mines are located. In one form of the game, pieces representing submarines at periscope depth are marked on their undersurface with a number "1". Submarine pieces in the dive mode have depths of from "2" to "6" marked on their undersurface with a china marking pencil, for example. Each player's primary playing pieces are distinguishable by color, for example, black and white.

TABLE 1

| Starting Positions of Playing Pieces | |
|---|---|
| PLAYER 1 (West) (white) | PLAYER 2 (East) (black) |
| Battleships: W4N1, W4S1 | Battleships: E4N1, E4S1 |
| Cruisers: W4N2, W4S2 | Cruisers: E4N2, E4S2 |
| Aircraft-carriers and fighter-bomber squadrons: W4N4, W4S4 | Aircraft-carriers and fighter-bomber squadrons: E4N4, E4S4 |
| Destroyers: W4N3, W4S3 W3N1, W3SI | Destroyers: E4N3, E4S3, E3N1, E3S1 |
| Submarines: | Submarines: |
| surfaced mode: W3N2, W3S2 | surfaced mode: E3N2, E3S2 |
| periscope mode: W3N3, W3S3 | periscope mode: E3N3, E3S3 |
| dive mode: W3N4, W3S4 | dive mode: E3N4, E3S4 |

Taking alternate turns each player is presented an opportunity to maneuver his playing pieces and/or attack his opponent's playing pieces. The first player must complete his play before his opponent is permitted to begin to maneuver and/or attack. Maneuvers are accomplished by choosing which three or less playing pieces are to be moved, and by determining the range of each of those playing pieces. Battleships, cruisers, aircraft-carriers and submarines may be moved as many squares as the playing piece has power rings 36 but submarines can also change depth. Destroyers can move as many dog-leg moves (1 diagonal+1 straight) as it has power-units. Fighter-bomber squadrons can "fly" four dog-legs and change altitude each turn.

Attacks are made against the opponent by maneuvering the attacking playing piece to within its firing range to the targeted playing pieces. Each player has a set of eight dice 64, two dice being used to indicate the altitude of aircraft squadron playing pieces 50 and the other six dice being used to determine the efficacy of fire-power and the extent of damage inflicted upon the opponent's targeted playing pieces. The number of dice used in an attack varies inversely with the distance between the attacking and the targeted playing pieces and the number of fire-power attacks per turn per warship depends on the number of remaining power-units of the attacking playing piece.

The number of clear rings remaining on the playing piece indicates the number of power units the playing piece has remaining. For example, initially the first playing piece 30, representing a battleship, has six clear "power" rings mounted on it and no red "damage" rings. This gives that piece six power units. Similarly, the cruiser playing piece 40 initially has five clear rings mounted on it, and thus has five power units.

During each turn each of three playing pieces may use up their allotted power units by maneuvering (i.e, movement on the game board), by attacking an enemy playing piece or by repairing damaged power-units. For example, the first playing piece 30, representing a battleship, could move three squares (a primary maneuver), attack an opponent's playing piece twice with fire-power, and retreat one square (a secondary maneuver). Each square of linear movement expends one power unit, each fire-power attack expends one power unit and each repaired damage-unit expends one power-unit.

Attacks on enemy vessels are made by rolling from one to six dice. As mentioned previously, six dice are provided for each of two players for use to determine fire-power efficacy during an attack. Basically, if one rolls the correct "range number" or the "distance" from the firing-warship to the targeted-warship on any die during an attack, damage is inflicted on the opponent's piece. Damage is also multiplied by the number of dice turning up the correct range number. However, the number of dice used in each attack, and the number of attacks, vary with the distance from the attacking playing piece to its target and the number of power units the playing piece has left after maneuvering to the target. The closer the target, the greater the number of dice are thrown. The more distant the target, the less the number of dice are thrown.

For example, a battleship playing piece 30, which initially has six power units, may attack an opponent's playing piece which is up to six squares away. A cruiser playing piece 40, which initially has five power units, may attack an opponent's playing piece which is up to five squares away. An aircraft-carrier playing piece 46, which initially has four power units, may attack an opponent's playing piece which is up to four squares away. A destroyer playing piece 42, which initially has three power units, may attack an opponent's playing piece which is up to three squares away. A submarine playing piece 44, which initially has two power units, may attack an opponent's playing piece which is two squares or 1 dog-leg away.

For shellfire: If the attacking playing piece is one square away, the attacker must roll six dice in each shellfire attack and the number of "1"s which are rolled indicate the number of damage units inflicted on the opponent's playing piece during any one attack. If the attacking vessel is two squares away from its target, only five dice may be rolled in each attack and the number of "2"s which are rolled indicate the number of damage units inflicted on the opponent's playing piece during any one attack. If the attacking vessel is three squares away from its target, only four dice may be rolled in each attack and the number of "3"s which are rolled indicate the number of damage units inflicted on the opponent's playing piece during any one attack. If the attacking vessel is four squares away from its target, only three dice may be rolled in each attack and the number of "4"s which are rolled indicate the number of damage units inflicted on the opponent's playing piece during any one attack. If the attacking vessel is five squares away from its target, only two dice may be rolled in each attack and the number of "5"s which are rolled indicate the number of damage units inflicted on the opponent's playing piece during any one attack. If the attacking vessel is six squares away from its target, only one die may be rolled in each attack and any "6"

that is rolled indicates one damage unit is inflicted on the opponent's playing piece during any one attack. Accordingly, the closer the attacking playing piece is to its target, the greater the probability that damage will be inflicted on the opponent's playing piece, as more dice may be used in each salvo of shell-fire. Each roll of the dice represents one salvo of shell-fire and expends one power-unit.

Depth chargers can be deployed by destroyers upon opponent's submarines by guessing the correct depth and rolling the correct depth number. For example, to hit a submarine at 3 depth units requires throwing 4 dice for "3"s. Any "3" turning up causes 2 damage units and sinks the submarines. To hit a submarine at a depth of 1 unit requires throwing 6 dice for "1"s, etc.

Torpedos can be fired by submarines at opponent's warships only when at periscope depth and when positioned one dog-leg from the targeted warship. Any "2" which turns up with the roll of 5 dice inflicts 3 damage units.

When damage is inflicted on an opponent's playing piece (i.e., for each correct range number that is rolled), one of the clear acrylic rings on the attacked piece, which represents a power unit, is removed and replaced with a red tinted acrylic damage ring. The number of power units which the attacked playing piece has remaining is equal to the number of clear power rings remaining on the playing piece. Damaged warships can be repaired only in naval-bases by replacing damage-unit rings with power-unit rings. Warships are considered sunk and removed from the board when all power-units have been displaced by damage-units.

Each player has two naval bases on his side of the board. Each naval base is comprised of three squares located at each corner. More specifically, one naval base of the first player comprises squares N6W5, N6W6 and N5W6, and the other naval base of the first player comprises squares S6W5, S6W6 and S5W6. One naval base for the second player comprises squares S6E5, S6E6 and S5E6, and the other naval base for the second player comprises squares N6E5, N6E6 and N5E6. Invasion of an opponent's naval base is accomplished by having a naval vessel land on any of the opponent's naval base squares. Capture of an opponent's naval base is accomplished by the failure of an opponent to sink an invading warship on the following turn.

The object of the game can vary from, firstly, by capturing either one of the opponent's naval bases; or secondly, by capturing both of the opponent's naval bases; or thirdly, by scoring more points than the opponent by sinking or damaging warships and capturing naval bases.

The present invention provides a board game which involves both strategy and chance, i.e., using dice to determine the outcome of an attack. The primary playing pieces are differentiated from one another by the height of their center post, and by the number of power rings or damage rings which the playing piece will accept, for example, a playing piece representing a cruiser will accept five rings. The rings represent the power, strength or capability of the playing pieces, and the rings are in the form of interchangeable power rings and damage rings, each of which are removable from the playing piece.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A naval battle board game, which comprises:

a game board having a playing surface, the playing surface having a plurality of squares of alternating colors and arranged contiguously in a checkerboard fashion;

a plurality of primary playing pieces, at least some of the primary playing pieces having a base member and a post mounted vertically on the base member and representing various types of naval vessels having different amounts of power and being capable of receiving different amounts of damage before being sunk; and a plurality of first and second visually distinguishable secondary playing pieces, the first and second secondary playing pieces being in the form of cylindrical rings, the inner diameter of the rings being at least slightly greater than the outer diameter of the posts of the primary playing pieces so as to be loosely mountable on the posts of the primary playing pieces in a stacked arrangement and easily removable therefrom during game play, the ring-shaped first secondary playing pieces indicating a unit of vessel power and the ring-shaped second secondary playing pieces indicating a unit of vessel damage, a stacked arrangement of first ring-shaped secondary playing pieces on a primary playing piece indicating a measured amount of vessel power, and a stacked arrangement of second ring-shaped secondary playing pieces on a primary playing piece indicating a measured amount of vessel damage.

2. A naval battle board game as defined in claim 1, wherein the playing surface of the game board is a matrix of 144 squares arranged in a $12\times12$ grid of alternating colored square and having two zones, an inner zone of 64 squares arranged in an $8\times8$ matrix, and an outer zone of 80 squares bordering and surrounding the inner zone in a symmetrical arrangement, the inner and outer zones being distinguishable by color.

3. A naval battle board game as defined by claim 1, wherein the playing surface includes a first line representing an "East-West" coordinate, and a second line transverse to the first and representing a "North-South" coordinate, the first and second lines dividing the playing surface into four quadrants and defining the center of the board at their intersection.

4. A naval battle board game as defined by claim 1, wherein the playing surface of the game board includes a border surrounding the plurality of squares, the border including indicia in the form of compass headings.

5. A naval battle board game as defined by claim 1, wherein the playing surface of the game board includes a border surrounding the plurality of squares, the border including indicia in the form of numbers and compass headings to help identify the location of any particular square on the playing surface.

6. A naval battle board game as defined by claim 1, which further comprises a plurality of dice, the dice being used to determine the success and extent of damage inflicted by a primary playing piece upon an opponent's primary playing piece during an attack, the manifestation of any damage on said opponent's primary playing piece being the replacement of a ring-shaped first secondary playing piece representing a unit of vessel power by a ring-shaped second secondary playing piece representing a unit of vessel damage.

7. A naval battle board game as defined by claim 1, wherein at least some of the primary playing pieces have vertical posts of different lengths so as to distinguish one primary playing piece from another primary playing piece.

8. A naval battle board game as defined by claim 7, wherein the vertical posts of at least some of the primary playing pieces have lengths which differ from one another such that only predetermined numbers of ring-shaped first and second secondary playing pieces may be fitted onto the posts in a stacked arrangement and so that the vessel power and damage receiving capability of one primary playing piece may be distinguishable from those of another primary playing piece.

9. A naval battle board game as defined by claim 1, wherein the vertical posts of the primary playing pieces are segmented to define segment portions, each segment portion being the same height as one stacked ring-shaped secondary playing piece, such that only one ring may be fitted per segment portion onto the posts in a stacked arrangement and the different types of primary playing pieces can be distinguished by their specific number of post segment portions.

10. A naval battle board game as defined in claim 1, wherein at least some of the primary playing pieces having vertical posts and base members further including heading indicating arrows on at least one of their vertical posts and their base members.

11. A naval battle board game as defined by claim 1, wherein the base members of the primary playing pieces include a magnet, and wherein the game board is formed of a material attractable to the magnets in the base members to help maintain the stability and position of the primary playing pieces on the playing surface.

12. A naval battle board game as defined by claim 11, wherein the base members further include a felt material mounted on the underside thereof.

13. A naval battle board game as defined by claim 1, wherein at least one primary playing piece includes a magnet mounted thereon, and at least another primary playing piece includes a material attractable to the magnet of said one primary playing piece to maintain the two primary playing pieces in a stacked arrangement.

14. A naval battle board game, which comprises:

a game board having a playing surface, the playing surface having 144 squares arranged in a checkerboard fashion of alternating shades of light, dark and medium blue, the playing surface further having two zones, an inner zone having 64 squares of dark and light blue colors and an outer zone having 80 square of light and medium blue colors, the game board further having border surrounding the plurality of squares, the boarder including indicia in the form of numbers and compass headings to help identify the location of any particular square on the playing surface;

first through fifth primary playing pieces representing naval vessels, including battleships, cruisers, destroyers, submarines and aircraft carriers, each of which having a different amount of power and being capable of receiving a different amount of damage before being sunk, said first through fifth primary playing pieces having a bases member and a post mounted on the base member in an upright position;

sixth primary playing pieces representing aircraft squadrons, the sixth primary playing pieces being in the general form of an airplane and including a first elongated member indicating airplane wings and a second elongated member disposed perpendicularly to the first member and indicating an airplane fuselage;

seventh primary playing pieces representing underwater mines, the seventh primary playing pieces being in the form of a solid cylindrical member;

a plurality of first secondary playing pieces, the first secondary playing pieces being in the form of cylindrical rings, the inner diameter of the rings being at least slightly greater than the outer diameter of the posts of the first primary playing pieces so as to be loosely mountable on the posts of the first through fifth primary playing pieces in a stacked arrangement and easily removable therefrom during game play, the first secondary playing pieces representing a unit of vessel power; and a plurality of second secondary playing pieces, the second secondary playing pieces being in the form of cylindrical rings and being visually distinguishable from the first secondary playing pieces, the inner diameter of the rings being at least slightly greater than the outer diameter of the posts of the first primary playing pieces so as to be loosely mountable on the posts of the first through fifth primary playing pieces in a stacked arrangement and removable therefrom. each of the second secondary playing pieces representing a unit of vessel damage;

the posts of the first through fifth primary playing pieces having different lengths so as to receive predetermined numbers of first and second secondary playing pieces in a stacked arrangement and thereby distinguishing one primary laying piece and the power and damage receiving capability of that primary playing piece from another primary playing piece, a stacked arrangement of first ring-shaped secondary playing pieces on a primary playing piece indicating a measured amount of vessel power, and a stacked arrangement of second ring-shaped secondary playing pieces on a primary playing piece indicating a measured amount of vessel damage.

15. A naval battle board game, which comprises:

a game board having a playing surface, the playing surface having 144 squares arranged in a checkerboard fashion of alternating shades of light, dark and medium blue, the playing surface further having two zones, an inner zone having 64 squares of dark and light blue colors and an outer zone having 80 square of light and medium blue colors, the game board further having border surrounding the plurality of squares, the boarder including indicia in the form of numbers prefaced with a compass heading, the location of any particular square on the playing surface specificable by two indicia which intersect the specific square at right angles to each other;

first primary playing pieces representing battleships, said first primary playing pieces having a base member and a cylindrical center post comprised of six segment portions mounted vertically on the base member;

second primary playing pieces representing cruisers, the second primary playing pieces having a base member and a cylindrical center post comprised of five segment portions mounted vertically on the base member;

third primary playing pieces representing destroyers, the third primary playing pieces having a base member and a cylindrical center post comprises of three segment potions mounted vertically on the base member;

fourth primary playing pieces representing submarines, the fourth primary playing pieces having a base member and a cylindrical center post comprises of two segment portions mounted vertically on the base member;

fifth primary playing pieces representing aircraft-carriers, the fifth primary playing pieces having a base member and a cylindrical off-center post comprises of four segment portions mounted vertically on the base member and a second vertical rectangular off-center post of the same height as the cylindrical post;

sixth primary playing pieces representing aircraft squadrons, the sixth primary playing pieces having a portion in the general form of an airplane, a base member and a short vertical transparent center post interconnecting the airplane resembling portion and the base member, the airplane resembling portion including a first elongated member indicating airplane wings and a second elongated member disposed perpendicularly to the first member and indicating an airplane fuselage;

seventh primary playing pieces representing underwater mines, the seventh primary playing pieces being in the form of a solid cylindrical member;

the first through fifth primary playing pieces representing naval vessels having different amounts of power and being capable of receiving different amounts of damage before being sunk;

a plurality of first secondary playing pieces, the first secondary playing pieces being in the form of cylindrical rings, the inner diameter of the rings being at least slightly greater than the outer diameter of the cylindrical posts of the first through the fifth primary playing pieces so as to be loosely mountable on the cylindrical posts of the first through the fifth primary playing pieces in a stacked arrangement and easily removable therefrom during game play, the first secondary playing pieces being composed of clear translucent material and representing a unit of vessel power for expenditure as one of vessel movement, fire-power and repair; and a plurality of second secondary playing pieces, the second secondary playing pieces being in the form of cylindrical rings, the inner diameter of the rings being at least slightly greater than the outer diameter of the cylindrical posts of the first through the fifth primary playing pieces so as to be loosely mountable on the cylindrical posts of the first through fifth primary playing pieces in a stacked arrangement and easily removable therefrom during game play, each of the second secondary playing pieces being composed of a red translucent/-fluorescent material and representing a unit of vessel damage and replacing first secondary playing pieces representing units of vessel power during game play;

the cylindrical posts of the first through the fifth primary playing pieces having different heights and number of segmented portions so as to receive predetermined numbers of first and second secondary playing pieces in a stacked arrangement and thereby distinguishing one primary playing piece and the power and damage receiving capability of that primary playing piece from another primary playing piece, a stacked arrangement of first ring-shaped secondary playing pieces on a primary playing piece indicating a measured amount of vessel power, and a stacked arrangement of second ring-shaped secondary playing pieces on a primary playing piece indicating a measured amount of vessel damage;

the first through fifth playing pieces having direction indicating arrows on the upper surface of their vertical cylindrical posts and on the upper surface of their base members, with both arrows pointing in the same direction.

* * * * *